US005314591A

United States Patent [19]

Katayama et al.

[11] Patent Number: 5,314,591

[45] Date of Patent: May 24, 1994

[54] ELECTROLYZER AND METHOD OF PRODUCTION

[75] Inventors: Shinji Katayama, Tamano; Yoshinari Take, Okayama, both of Japan

[73] Assignee: Chlorine Engineers Corp., Ltd, Tokyo, Japan

[21] Appl. No.: 904,251

[22] Filed: Jun. 25, 1992

[30] Foreign Application Priority Data

Jun. 26, 1991 [JP] Japan ..... 3-154687
Jun. 26, 1991 [JP] Japan ..... 3-154688
Jul. 1, 1991 [JP] Japan ..... 3-160260

[51] Int. Cl.[5] ..... C25B 9/00; C25B 11/02; C25B 15/08

[52] U.S. Cl. ..... 204/257; 204/258; 204/269; 204/270; 204/280; 204/289

[58] Field of Search ..... 204/255-258, 204/269-270, 290 R, 286-289, 263-266, 280

[56] References Cited

U.S. PATENT DOCUMENTS 4,464,242 8/1984 Boulton ..... 204/288 X
4,746,415 5/1988 Boulton et al. ..... 204/290 R X
4,767,519 8/1988 de Nora ..... 204/290 R X
5,174,878 12/1992 Wullenweber et al. .... 204/290 R X

*Primary Examiner*—Donald R. Valentine
*Attorney, Agent, or Firm*—Armstrong, Westerman, Hattori, McLeland & Naughton

[57] ABSTRACT

An electrolyzer includes a stack composed of a plurality of upright electrolytic cell units, each unit including an electrolytic cell unit frame bounding a pair of electrode sheets. Each pair of electrode sheets are anode-side and cathode-side partitions having opposed recesses and projections that are engaged in nesting relationship with each other. A gas-liquid separation chamber is provided which is integral with an upper edge of the electrolytic cell unit frame.

10 Claims, 12 Drawing Sheets

ELECTROLYZER AND METHOD OF PRODUCTION

BACKGROUND OF THE INVENTION

The present invention relates generally to a filter press type electrolyzer and, more particularly, to an electrolytic cell unit which is characterized by a partition for dispensing an electrolyte into adjacent electrolytic chambers.

Filter press type electrolyzers are widely used for inorganic material production by electrolysis, including chlorine and caustic soda production by brine electrolysis as well as for electrolysis of seawater, etc.

Among the filter press type electrolyzer used typically for brine electrolysis, there are two types, one a bipolar type built up of a stack of bipolar type electrolytic cell units partitioned by a cation exchange membrane, each unit including adjacent anode and cathode chambers electrically and mechanically joined to each other through a partition, and end electrode chambers attached and fixed as by hydraulic pressing on both ends thereof, each of said chambers having an anode or cathode on one side, and the other a monopolar type built up of a stack of anode and cathode chamber units having the same electrodes attached to the both sides of a picture frame form of electrode chamber frame partitioned by a cation exchange membrane and electrode chamber units attached to both ends thereof, each of said electrode chamber units having an anode or cathode on one side. Each electrode chamber unit of the monopolar type electrolyzer is provided with downcomers, ribs, etc. which reinforce the picture frame form of electrode chamber frame and serves to promote the circulation of an electrolyte. The electrodes are attached to these ribs, but there is usually no partition for separating the electrolyte.

On the other hand, each unit of the bipolar type electrolyzer is provided with partitions serving to separate the anode from the cathode chamber and to conduct an electrolytic current. The partitions for separating the anode from the cathode chamber are provided with an anode and a cathode. Depending on what electrolytic reactions are to take place, one of the anode and cathode chambers is exposed to an oxidizing environment and the other to a reducing environment. Especially in the case of brine electrolysis that is a typical electrolysis process making use of ion exchange membranes, chlorine is generated at the anode, while high concentrations of sodium hydroxide and hydrogen are formed at the cathode. Thus, a thin-film forming metal highly resistant to corrosion as by chlorine such as titanium, tantalum or zirconium or its alloy is used for the anode chamber. However, titanium absorbs hydrogen and embrittles in an atmosphere prevailing in the cathode chamber; in other words, titanium cannot be used for the cathode chambers, albeit highly resistant to corrosion.

For that reason, a ferrous metal such as iron, nickel or stainless steel or its alloy is used for the cathode chamber. Although electrical connection may be made by connecting electrode chambers to each other, each formed by a partition of metal material, no joint of practical strength can be obtained, even though titanium forming the anode chamber is directly joined to iron, nickel or stainless steel forming the cathode chamber as by welding, because titanium forms an intermetallic compound with the ferrous metal.

Thus, many proposals have been made for the bipolar type electrolyzer. For instance, Japanese Patent Publication No. 53-5880 discloses that the members forming the anode and cathode chambers are connected to each other by bolts passing through a partition formed of synthetic resin material.

Japanese Patent Publication No. 52-32866 discloses that a ferrous metal is explosively fused to titanium to form a sheet member serving as a partition, and both its sides are provided with ribs by welding and anodes and cathodes are welded to the ribs. Japanese Patent Publication No. 56-36231 teaches that a composite member is provided by joining together titanium and iron with copper between them, the titanium of the composite member is welded to the titanium of the anode-side partition of a bipolar type electrolytic cell unit, and the iron of the composite member is likewise welded to the cathode-side partition of a ferrous metal.

As mentioned above, various partitions are proposed for the bipolar type electrolyzer. However, since they all include partitions provided with ribs and electrodes welded or otherwise attached to the ribs, there are unavoidably voltage drops. In addition, special procedures must be used to join the cathode-side metal to the anode-side metal.

In order to solve such problems, Applicant has already proposed a bipolar type electrolyzer which includes electrolytic cell units, each formed by a pressed sheet of partitions having recesses (or grooves) and projections (or ribs) that are engaged with each other and electrodes joined to the projections, and which is simply assembled as well (see Japanese Provisional Patent Publication No. 3-249189 or Japanese Patent Application No. 2-45855).

In the case of an electrolytic reaction generating large amounts of gases, such as brine electrolysis by the ion exchange membrane process, zones in which the generated gases or liquids containing much bubbles remain stagnant are located upper part of electrode chambers. As well known in the art, the gas or air bubble-containing zones have an adverse influence on the ion exchange membranes during extended operation. In order to reduce the gas or bubble-containing zones, some improvement is made on where nozzles for releasing an electrolyte or the generated gases are to be located, or a gas-liquid separation chamber is located above the electrolytic cell unit, whereby the ion exchange membranes are prevented from coming into contact with the bubbles. If an electrolyzer having a large electrode area is operated while the current distribution in each electrode chamber remains uneven, then the performance of the electrolyzer is adversely affected; that is, local consumption of the electrodes occurs or local degradation of the ion exchange membranes takes place. Thus, where the electrodes and collector members are to be located is such designed as to make anode-partition-cathode-anode passages virtually equal to each other, thereby making the current distribution in each electrode chamber uniform.

Furthermore, it is attempted to reduce the concentration or temperature distribution of the electrolyte in each electrode chamber. Reducing the concentration or temperature distribution of the electrolyte is achieved by increasing the amount or rate of circulation of the electrolyte which is externally fed to the electrode chamber and discharged therefrom. However, increasing the amount of circulation needs a circulator of large size, and is not always effective as well in terms of making the concentration or temperature distribution of the electrolyte uniform.

In the case of an electrolytic cell unit including a pressed flat sheet, however, whatever measure is taken for where the electrolyte or the nozzle for releasing the gas generated is to be located, a region in which the gases remain stagnant occurs unavoidably upper portion of the electrolytic chamber.

Making the concentration or temperature of the electrolyte uniform may effectively be achieved by the uniform feeding of the electrolyte to the electrode chamber. However, never until now is an electrolyte-dispensing means used for electrolytic cell units making use of pressed sheets.

The section of the lower portion of a conventional electrolytic cell unit using a pressed sheet is shown in FIG. 12(A). As illustrated, there is an electrolytic cell frame 32 lower portion of the electrolytic cell unit generally shown at 31, and a partition 34 is attached to the frame 32 to form an electrode chamber 33. And an electrode 35 is mounted on the partition 34. Thus, the lower portion of the electrode chamber is constructed from the frame 32 formed of rigid material; in other words, some structural difficulty is encountered in providing means for dispensing the electrolyte uniformly.

The section of the upper portion of the electrolytic cell unit using a pressed sheet is shown in FIG. 12(B). As illustrated, the upper portion of the electrode chamber 33 of the electrolytic cell unit 31 is built up of an electrode chamber frame 32 formed of rigid material; that is, it is again structurally difficult to locate a gas-liquid separation chamber thereabove. Within the electrode chamber 33, there is left a space in which the electrode 35 is not located. This space is then sectioned by a parting member 36 formed of a metal sheet similar to the partition 34, thereby forming a gas-liquid separation chamber 38 provided with a passage 37 through which a gas-liquid mixture is introduced between said chamber 38 and the electrode chamber. However, problems with this arrangement are that the portion to be welded is so long and linear that this metal sheet forming the partition is distorted by welding, failing to provide an electrolytic cell unit to meet the mechanical accuracy demanded.

SUMMARY OF THE INVENTION

According to one aspect of this invention, there is provided an electrolyzer comprising a stack of upright electrolytic cell units, each including an electrode sheet joined to the ribs of a partition sheet obtained by pressing together anode- and cathode-side partitions having recesses and projections that are engaged with each other, wherein:

said upper partition is bent down to form a gas-liquid separation chamber built up of a member integral therewith, the outside of said gas-liquid separation chamber serves as a flange surface between adjacent electrolytic cell units when said electrolytic cell units are stacked up, and a passage is formed between an electrode chamber and said gas-liquid separation chamber to separate a gas from a gas-liquid mixture rapidly.

According to another aspect of this invention, there is provided an electrolyzer comprising a stack of upright electrolytic cell units, each including an electrode sheet joined to the ribs of a partition sheet obtained by pressing together anode- and cathode-side partitions having recesses and projections that are engaged with each other, wherein:

said lower partition is bent down to form an electrolyte dispensing and feeding chamber built up of a member integral therewith and having a uniform array of passages of small sectional area for feeding an electrolyte to an electrode chamber uniformly and at high speed, and the outside of said gas-liquid separation chamber serves as a flange surface between adjacent electrolytic cell units when said electrolytic cell units are stacked up.

According to a further aspect of this invention, there is provided an electrolytic cell assembly comprising a stack of upright electrolytic cell units, each including an electrode sheet joined to the ribs of a partition sheet obtained by pressing together anode- and cathode-side partitions having recesses and projections that are engaged with each other, wherein:

each electrolytic cell unit includes a partition sheet vertically provided with recesses and projections, said partition sheet is divided into a plurality of zones in the height direction, the grooves in one zone are in line with the projections in the other zone, one groove in one zone communicates with the adjacent recesses in the same zone through a passage, and the grooves in one zone communicate with the recesses in the other zone through fluid-communicating channels.

DESCRIPTION OF THE PREFERRED EMBODIMENT

The present invention will now be explained more specifically but not exclusively with reference to the accompanying drawings.

Figure 1A:
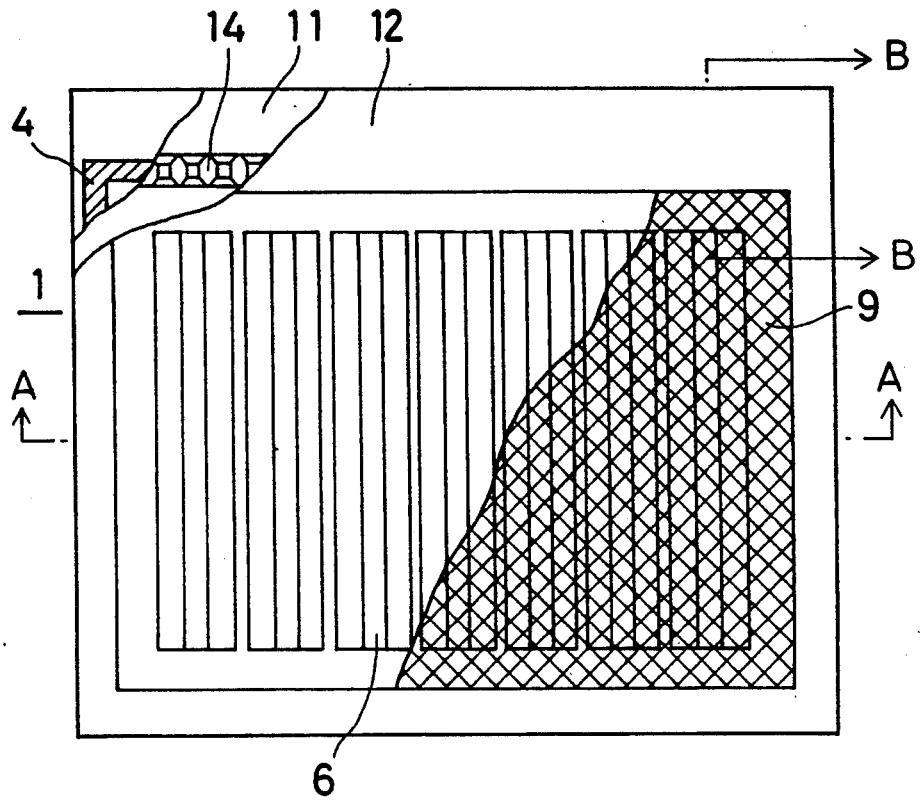
FIG. 1(A) is a partly cut-away plane view of the electrolytic cell unit having a gas-liquid separation chamber according to this invention, as viewed from the anode side.
Figure 1B:
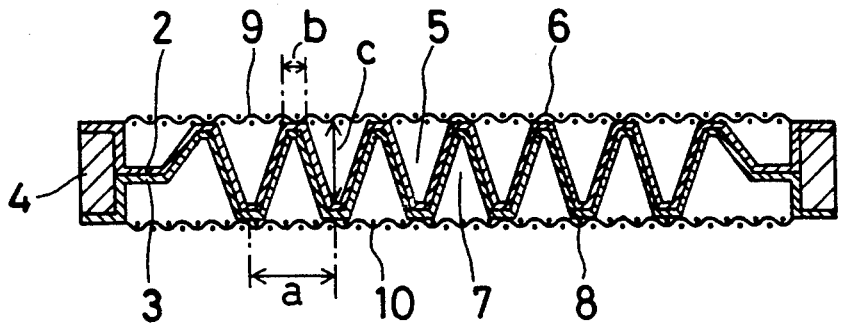
FIG. 1(B) is a sectional view taken alone the line A—A of FIG. 1(A)
Figure 2:
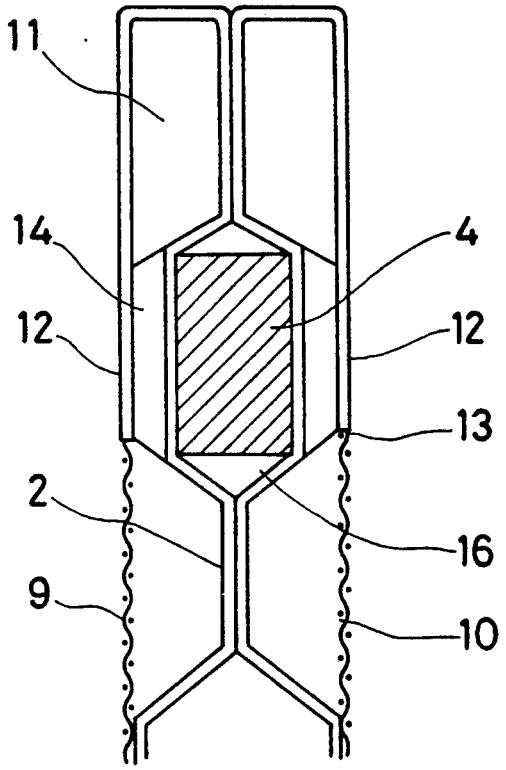
FIG. 2 is a longitudinally sectioned view of an upper portion of the electrolytic cell unit shown in FIG. 1(A)

FIG. 1(A) is a partly cut away plane view showing one embodiment of the electrolytic cell unit of this invention, which is viewed from the anode side; FIG. 1(B) is a sectional view taken along the line A—A of FIG. 1(A); and FIG. 2 is a sectional view taken along the line B—B of FIG. 1(A), which represents the longitudinally upper section of the embodiment.

As illustrated, an electrolytic cell unit 1 includes on the anode side a partition 2 built up of a pan form of sheet made of a member selected from the group consisting of a thin-film forming metal such as titanium, zirconium and tantalum and an alloy thereof and on the cathode side a partition 3 again built up of a similar form of sheet made of iron, nickel, stainless steel or the like. These partitions are attached to an electrolytic cell unit frame 4. Both the partitions include a groove form of recesses and a rib form of projections which are engaged with each other; that is, the anode-side partition is provided with a groove form of recess 5 and a rib form of projection 6, while the cathode-side partition is provided with a groove form of recess 7 and a rib form of projection 8 at positions where they are engaged with the projection 6 and recess 5 on the anode side.

Preferably, any groove/rib combinations are not provided on areas adjacent to the upper, lower and side walls of each electrode chamber so as to define an electrolyte circulation path. An anode 9, which is formed by coating an expanded metal, perforated metal or other sheet with an anodically active substance such as an oxide of a platinum group metal, is welded to or otherwise mounted on the projections in the anode-side partition 2. A cathode 10, which is again formed by coating an expanded metal, perforated metal or other sheet with a cathodically active substance such as a nickel or platinum group metal, is welded or otherwise joined to the projections in the cathode-side partition 3.

In this connection, it is noted that the electrodes may be attached directly or through a spring member for regulating an inter-electrode gap to the projections in the partitions.

In the upper zone of the electrolytic cell unit, there is a gas-liquid separation chamber 11 wherein gases are separated from a gas-liquid mixture produced in the electrolytic cell. To this end, as illustrated in FIG. 2, a vertically extending partition is bent at right angles with the electrode-mounted plane along a horizontal line in such a way that it surrounds the electrolytic cell frame 4. Further, that partition is bent down at right angles by a distance corresponding to the thickness of the electrode chamber in such a way that the outer surface of the gas-liquid separation chamber 11 forms a flange 12 of the electrolytic cell. Finally, the lowermost end 13 of the partition is partly joined to the electrode so as to hold it in place.

In order to make a division between the gas-liquid separation chamber and the electrode chamber, there is provided a communication path between them, thereby increasing the efficiency of gas-liquid separation.

Figure 3:
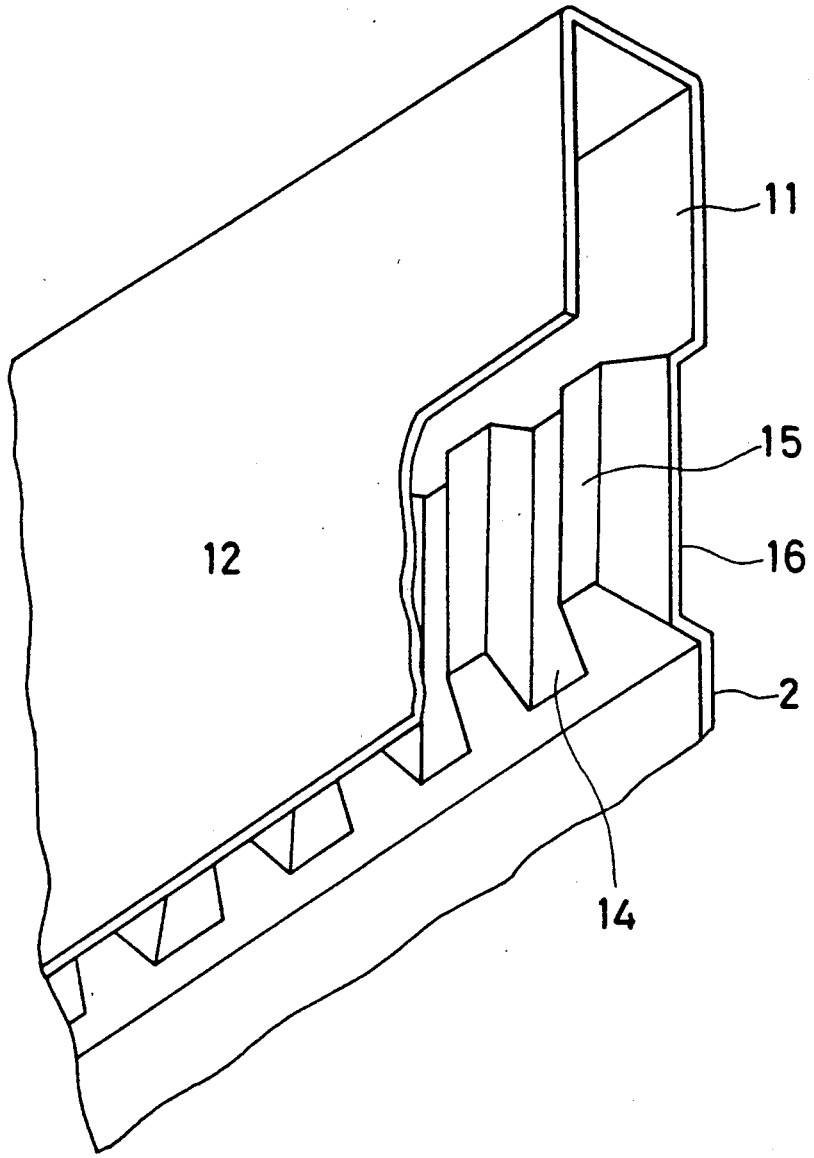
FIG. 3 is a partly cut-away perspective view of the gas-liquid separation chamber region.

Referring to FIG. 3 that is a partly cut-away, perspective view of the gas-liquid separation chamber zone, a partition is formed to provide the communication path 14, and a joint surface 15 is joined to the back side of the flange 12 of the electrolytic cell unit to ensure that the electrolytic cell unit holds sufficient mechanical strength. The partition is also provided with a niche 16 for mounting the electrolytic cell frame.

Figure 4A:
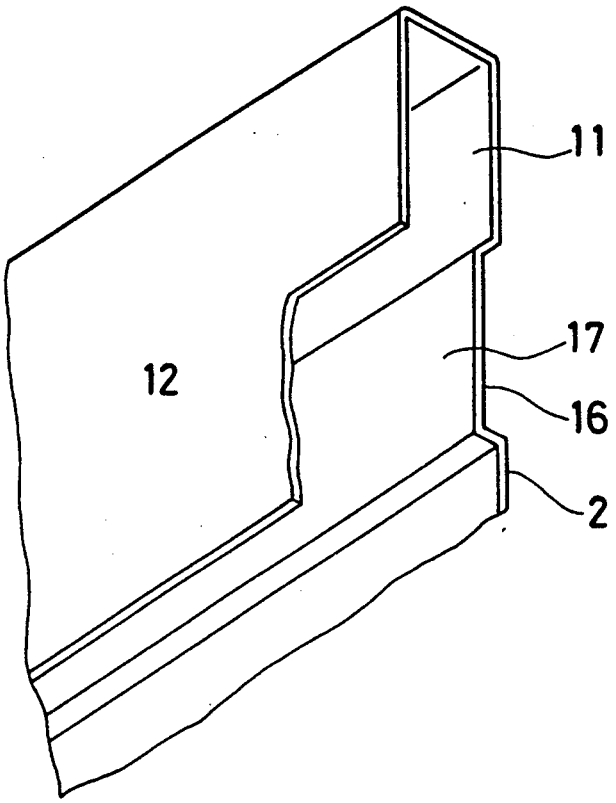
FIG. 4(A) is a partially cut-away perspective view of a gas-liquid separation chamber region.
Figure 4B:
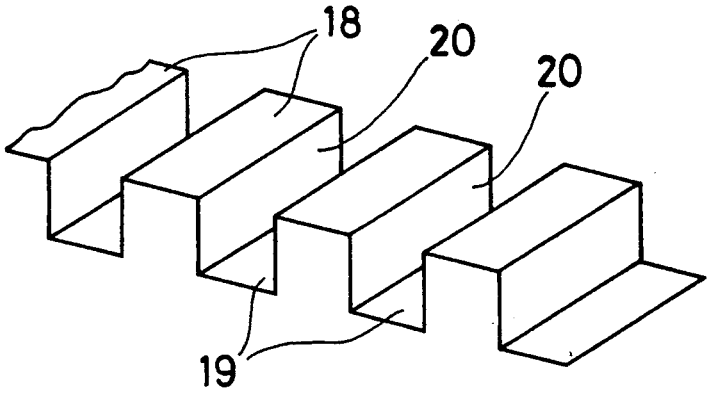
FIG. 4(B) illustrates an arrangement for promoting gas-liquid separation.

Alteratively, as illustrated in FIG. 4(A), only the niche 16 for mounting the electrolytic cell frame may be provided in the passage between the electrode and gas-liquid separation chambers without forming a joint surface for the flange. And, as shown in FIG. 4(B), a passage 17 is formed by the back side of the flange, which is provided with a thin metal sheet which is such undulated by pressing as to have a plurality of undulations, each having a height corresponding to the spacing of the passage 17 and defined by an apex plane 18, trough planes 19 in parallel therewith and side planes 20 in parallel with each other and contiguous to the apex and trough planes at right angles. This arrangement enables a plurality of slits to be formed in the passage and the passage to be mechanically held in place. Provision of wire gauzes or meshes on the slits is preferable, because they assist in rapid separation of bubbles into gas and liquid.

Figure 5A:
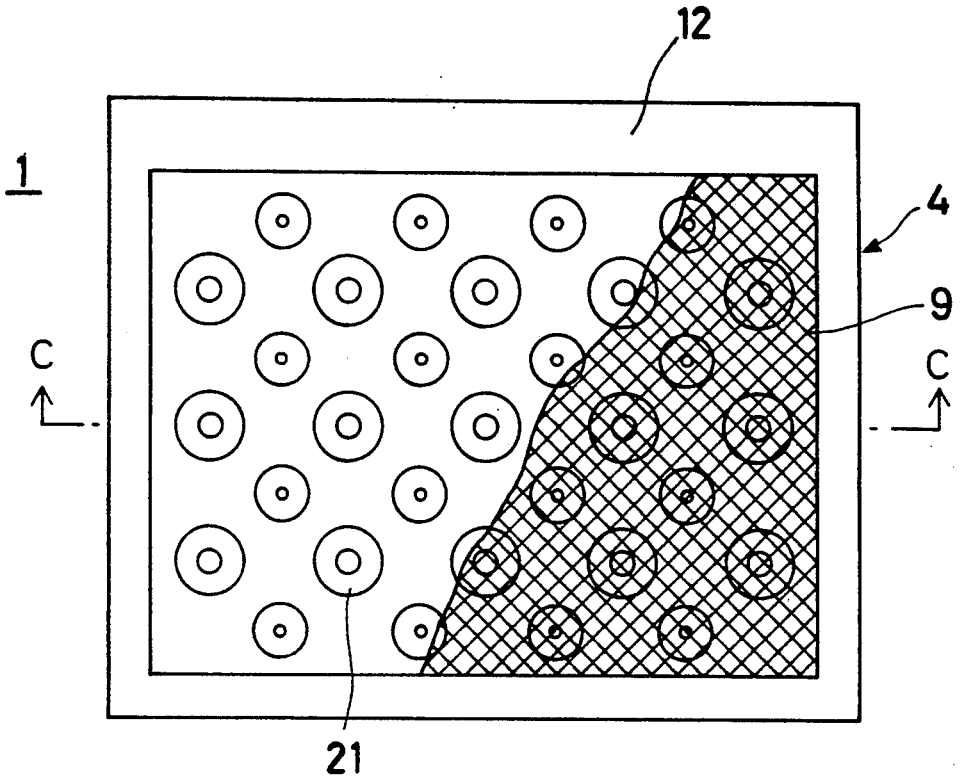
FIG. 5(A) is a partly cut-away plane view of the electrolytic cell unit making use of a partition sheet having recesses and projections, all in bowl forms.
Figure 5B:
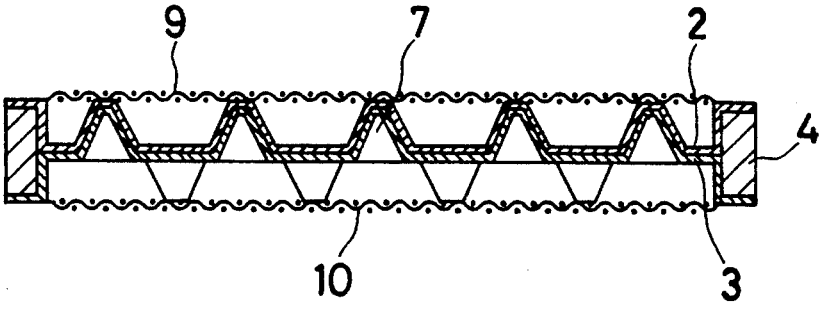
FIG. 5(B) is a sectional view taken along the C—C line of FIG. 5(A)

As can be best seen from FIG. 5(A) that is a partly cut-away plane view of the electrolytic cell and FIG. 5(B) that is a sectional view taken along the line C—C of FIG. 5(A), an array of recesses and projections 21 all in truncated-cone shapes may be used in place of the groove-rib combinations illustrated in FIGS. 1 and 2.

Figure 6:
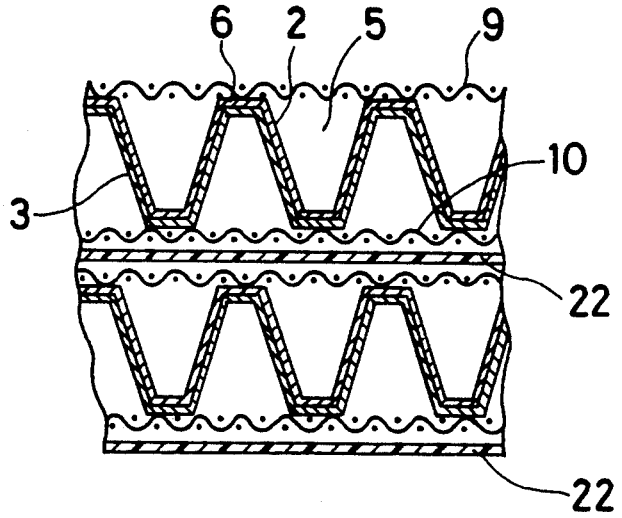
FIG. 6 represents an arrangement of adjacent electrolytic cell units, when assembled into an electrolyzer.

As illustrated in FIG. 6 that are sectional views of adjacent electrolytic cells, an electrolyzer is set up by stacking up a plurality of electrolytic cell units. In order to make a current distribution uniform, it is then preferred that the ribs of one polarity be arranged in the same linear form and adjacent electrolytic cell units be located in such a way that the ribs are opposite to the grooves with an ion exchange membrane 22 between them.

Figure 7A:
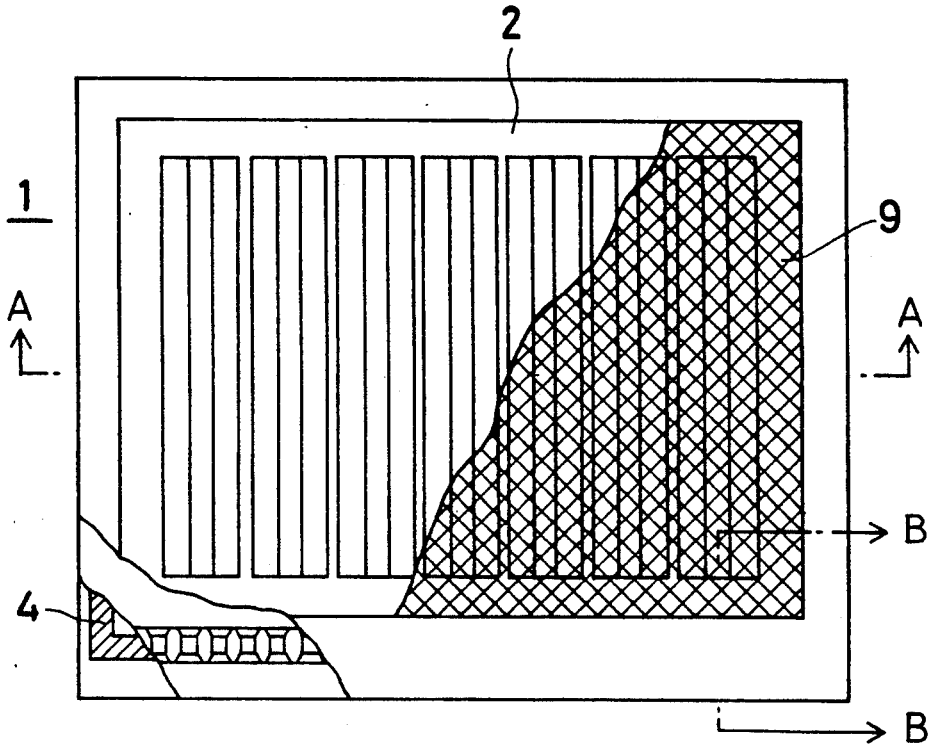
FIG. 7(A) is a partly cut-away plane view of the electrolytic cell unit having an electrolyte dispensing and feeding chamber according to this invention, as viewed from the anode side.
Figure 7B:
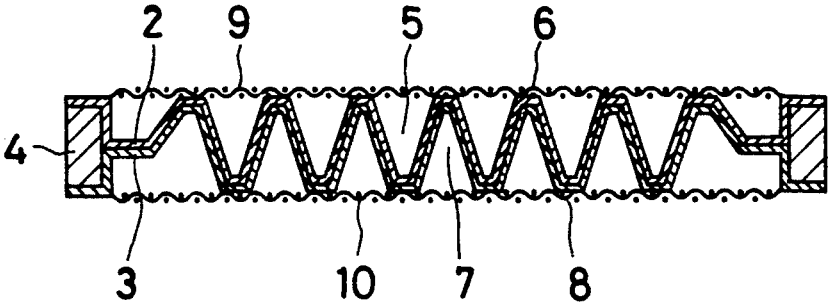
FIG. 7(B) is a sectional view taken along the line A—A of FIG. 7(A)
Figure 8:
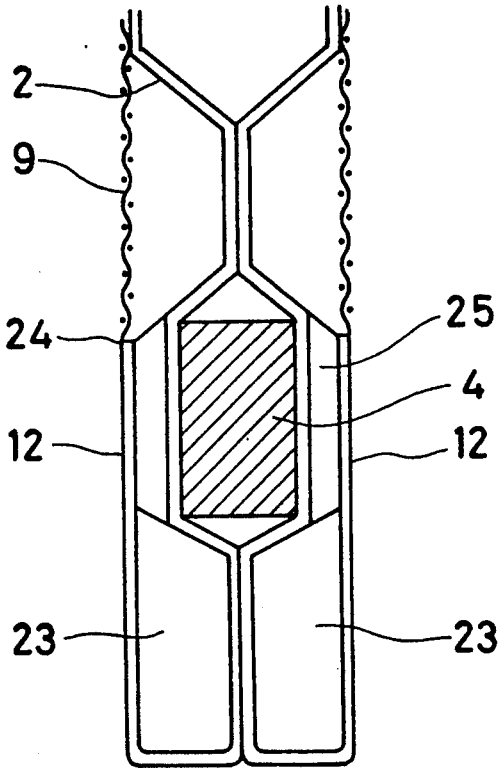
FIG. 8 is a longitudinally sectional view of a lower portion of the electrolytic cell unit shown in FIG. 7(A)

FIG. 7 represents another embodiment of the electrolytic cell unit of this invention, and FIG. 8 is a sectional view showing the longitudinally lower zone thereof taken along the line B—B of FIG. 7(A).

As illustrated, in the lower zone of the electrolytic cell unit there is formed an electrolyte dispensing and feeding chamber 23 for feeding the electrolyte uniformly into the electrode chamber. To this end, a vertically extending partition is bent at right angles with the electrode-mounted plane along a horizontal line in such a way that it surrounds the electrolytic cell frame 4. Further, that partition is bent down at right angles by a distance corresponding to the thickness of the electrode chamber in such a way that the outer face of the feed chamber 23 forms a flange 12 of the electrolytic cell. Finally, the lowermost end 24 of the partition is partly joined to the electrode so as to hold it in place.

In order to feed the electrolyte into the electrode chamber at high speed, a passage 25 having a small sectional area is interposed between the electrolyte dispensing and feeding chamber and the electrode chamber.

Figure 9:
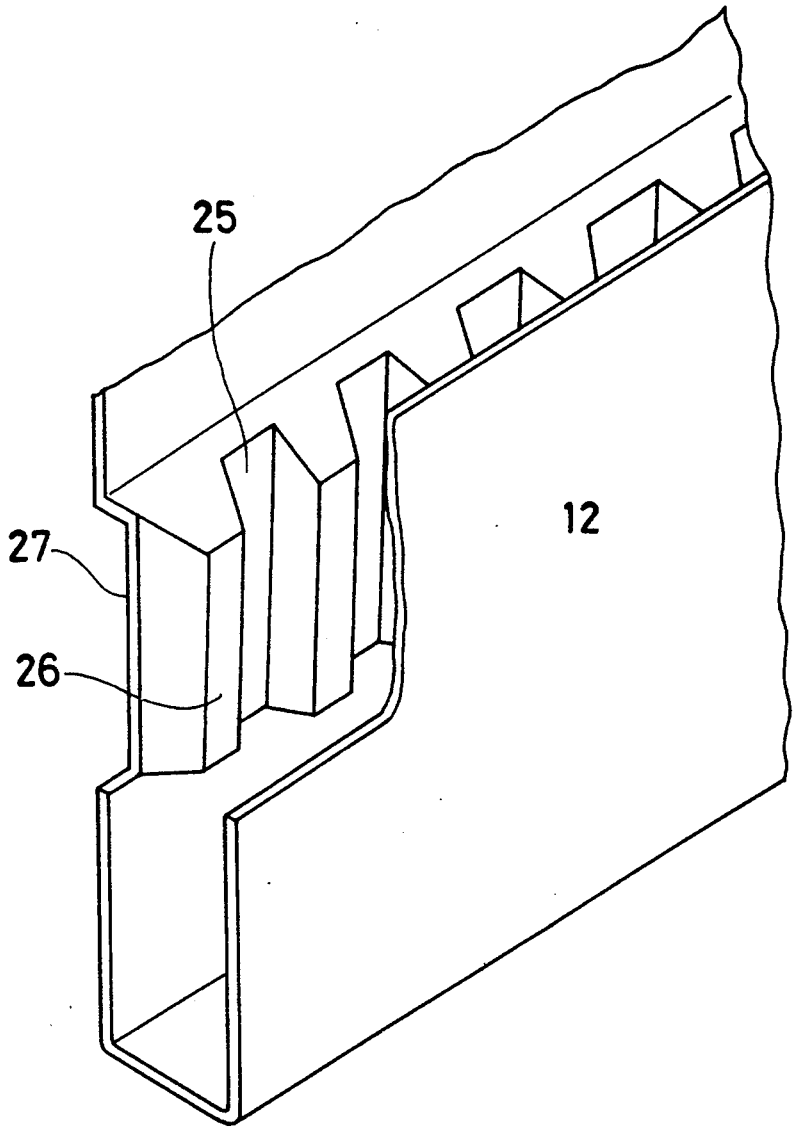
FIG. 9 is a partly cut-away perspective view of the electrolyte dispensing and feeding chamber.

As can be best seen from FIG. 9 that is a partly cut-away, perspective view of the electrolyte dispensing and feeding chamber zone, a partition is formed to provide a passage 25, and a joint surface 26 is joined to the back side of the flange 12 of the electrolyte cell unit to ensure that the electrolytic cell unit holds sufficient mechanical strength. Again, as shown in FIGS. 4(A) and 4(B), an array of recesses and projections all in bowl forms may be used in place of the groove-rib combinations.

Figure 10:
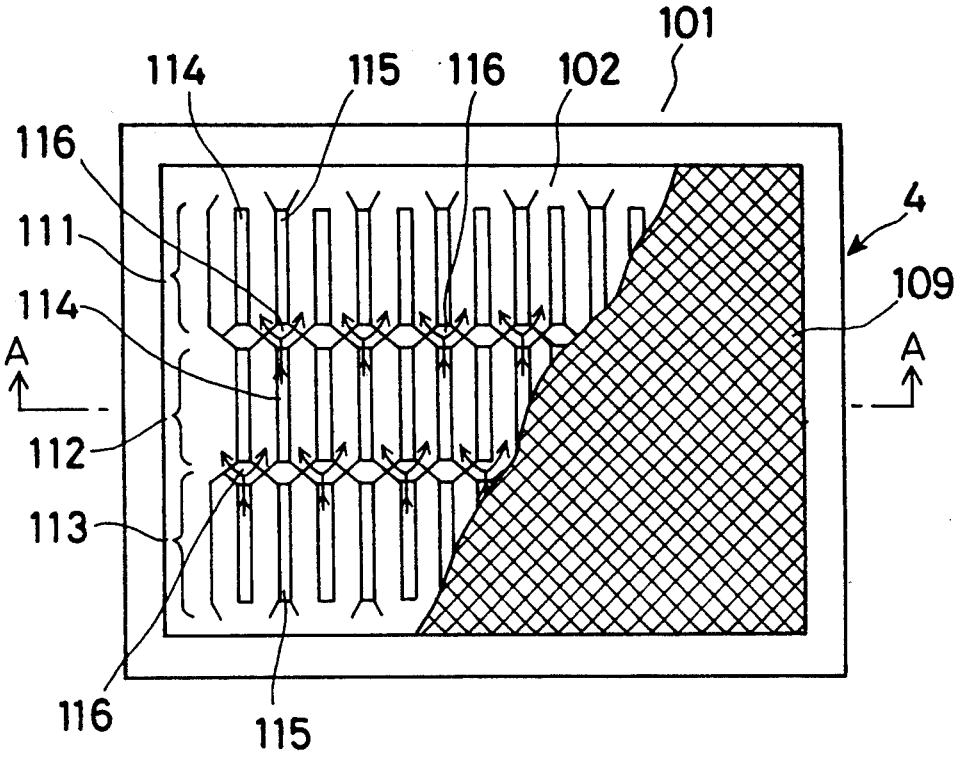
FIG. 10(A) is a partly cut-away plane view of the electrolytic cell unit including a partition sheet divided into three zones in the height direction and provided with recesses and projections, as viewed from the anode side.
FIG. 10(B) is a sectional view taken along the line A—A of FIG. 10(A)
Figure 10:
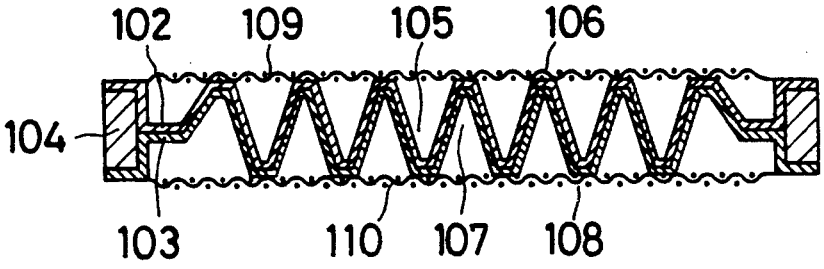
Figure 11:
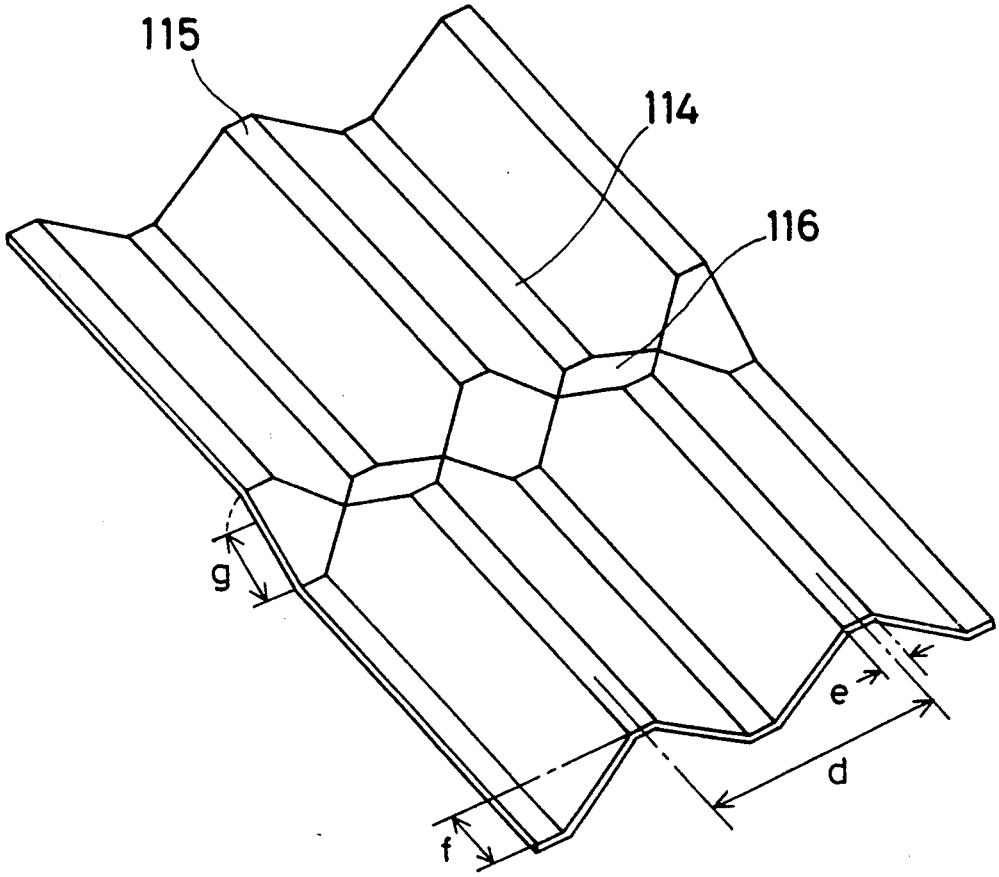
FIG. 11 is a perspective view of a part of the partition sheet, and FIGS. 12(A) and (B) are sectional views of the lower and upper portions of a conventional electrolytic cell unit built up of a pressed flat sheet.
Figure 12A:
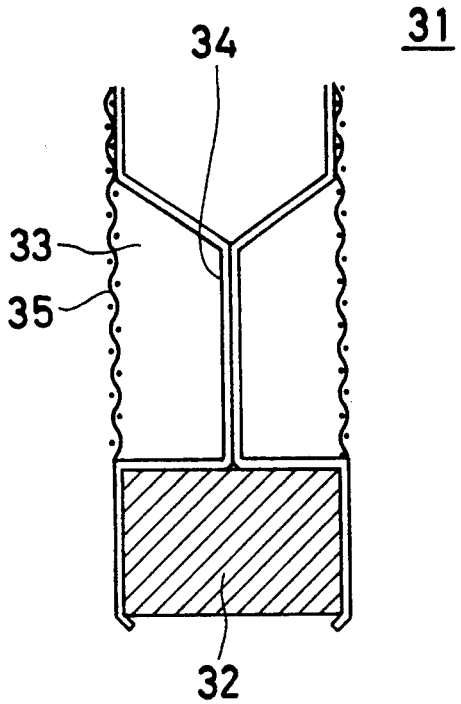
Figure 12B:
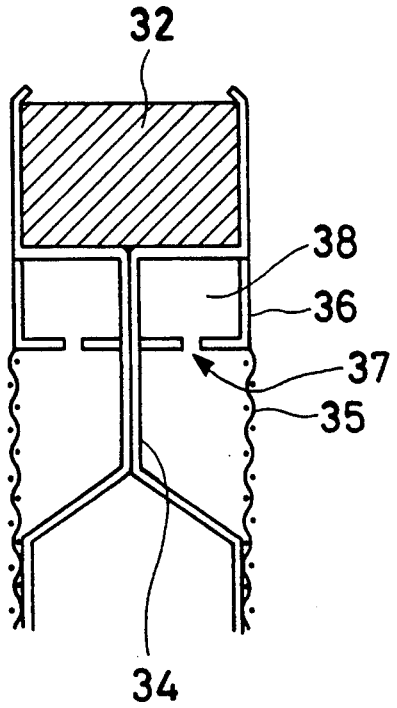

FIG. 10(A) is a partly cut-away, plan view of one embodiment of the electrolytic cell unit of this invention, which is viewed from the anode side; FIG. 10(B) is a sectional view taken along the line A—A of FIG. 10(A); and FIG. 11 is a perspective view showing a part of the partition sheet.

As illustrated, an electrolytic cell unit 101 includes on the anode side a partition 102 built up of a pan form of sheet made of a member selected from the group consisting of a thin-film forming metal such as titanium, zirconium and tantalum and an alloy thereof and on the cathode side a partition 103 again built up of a similar form of sheet made of iron, nickel, stainless steel or the like. These partitions are attached to an electrolytic cell unit frame 104. Both the partitions include a groove form of recesses and a rib form of projections which are engaged with each other; that is, the anode-side partition 102 is provided with a groove form of recesses 105 and a rib form of projections 106, while the cathode-side partition 103 is provided with a groove form of recesses 107 and a rib form of projections 108 at positions where they are engaged with the projections 106 and recesses 105 on the anode side.

An anode 109, which is formed by coating an expanded metal, perforated metal or other sheet with an anodically active substance such as an oxide of a platinum group metal, is welded to or otherwise mounted on the ribs in the anode-side partition 102. A cathode 110, which is again formed by coating an expanded metal, perforated metal or other sheet with a cathodically active substance such as a nickel or platinum group metal, is welded or otherwise joined to the ribs in the cathode-side partition 103.

In this connection, it is noted that the electrodes may be attached directly or through a spring member for regulating an inter-electrode gap to the ribs in the partitions.

Each partition is divided into three zones, an upper zone 111, an intermediate zone 112 and a lower zone 113, each provided with vertically extending grooves 114 and ribs 115. Between the respective zones, there are located fluid-communicating channels 116 for making communication between adjacent grooves 114 and between upper and lower grooves 114. An electrolyte introduced from below the electrode chamber goes up together with the gas generated in the electrolytic cell unit through each groove 114, as shown in FIG. 10(A), and bifurcate through the associated fluid-communicating channel 116 into the associated two grooves 114, located above, during which the electrolyte is well mixed into a uniform state. It is noted that the partition may be divided into four or more zones.

It is preferred that the grooves and ribs be provided all over the surface of the partition. In order to secure a number of electrolyte passages, it is also preferred that the bottom or top face area of each groove or rib be as small as needed for attaching an electrode thereto.

It is noted that the electrolyzer of this invention may be provided with a gas-liquid separation chamber and an electrolyte dispensing and feeding chamber, as shown in FIGS. 3 and 8.

The anode- and cathode-side partitions may be undulated one by one with an ordinary pressing machine. It is noted, however, that this may be achieved by the same pressing mold, because the anode- and cathode-side partitions are in the same form. If the anode- and cathode-side partitions are pressed together while laminated one upon the other, then it is possible to simplify the process of producing the partition sheet, because they can be undulated and, at the same time, made integral with each other.

The anode- and cathode-side partitions may be joined directly to each other by spot welding. Alternatively, they may be electrically and mechanically joined to each other by fitting with electrically conductive grease between them without recourse to permanent joining means such as welding.

After the electrolytic cell units are stacked up into an electrolyzer, the electrode chambers may be pressurized to generate a pressure difference between both the partitions and the outside, thereby bringing them in closer contact with each other. Alternatively, a space formed between both the partitions and the electrode chamber frame may be kept airtight. In this case, that space is subjected to reduced pressure to generate a pressure difference between both the partitions and the electrode chamber.

The electrolytic cell assembly according to this invention will now be explained more specifically with reference to electrolysis of a brine by the ion exchange membrane process.

EXAMPLE 1

A 1.0 mm thick titanium sheet provided with grooves or ribs—shown at a in FIG. 1(B)—at an interval of 110 mm and trapezoidal ribs having an upper width, b, of 10 mm and a height, c, of 25 mm and a 1.0 mm thick nickel sheet provided with similar engaging ribs and grooves were attached to a picture frame form of an electrolytic cell frame made of steel. Then, a 1400 mm×935 mm electrode for electrolysis of brine (made by Permelec Electrode Ltd.) was attached to the anode chamber-side titanium sheet, while a cathode of similar size, which was provided with an active coating and made of an expanded metal of nickel, was mounted on the cathode chamber-side nickel sheet. The effective electrode area of the electrolytic cell was 1.309 $m^2$.

A 100 mm high gas-liquid separation chamber provided with passages of 10 mm in width, 5 mm in depth and 30 mm in length at an interval of 20 mm was located above the anode and cathode chambers by pressing titanium and nickel sheets.

With a cation exchange membrane (N954 made by Du Pont) between the anode and cathode, brine at a concentration of 200 g/l was fed to the anode chamber, where it was electrolyzed at a temperature of 90° C. and a current density of 5.0 $kA/m^2$ to obtain 32% by weight of an aqueous solution of sodium hydroxide from the cathode chamber.

The electrolytic voltage was 3.35 V, the current efficiency was 94%, and the voltage drop due to the resistance of the electrolytic cell structure was 15 mV. In the anode chamber, pressure variations of 20 $mmH_2O$ were observed 13 times per minute. The concentration of oxygen in chlorine was 1.5%, while the concentration distribution of the brine in the anode chamber was 50 g/l at most.

EXAMPLE 2

Electrolysis of brine was carried out following the conditions of Ex. 1 with the exception of providing a 100 mm high electrolyte dispensing and feeding chamber below the anode and cathode chambers, in which passages of 10 mm in width, 5 mm in depth and 30 mm in length were combined with each other at an interval of 20 mm. As a result, it was found that the electrolytic voltage and current efficiency were 3.30 V and 95%, respectively, and in the anode chamber pressure variations of 20 $mmH_2O$ were observed 13 times per minute, but the difference in concentration of the brine in the anode chamber dropped to 20 g/l or less. It was also noted that the concentration of oxygen in chlorine was 1.0%.

EXAMPLE 3

Electrolysis of a brine was conducted under the conditions of Ex. 1 with the exception that the partition of the electrode chamber was divided into upper, intermediate and lower zones, each provided with grooves or ribs at an interval—shown at d in FIG. 11—of 110 mm, ribs having an upper width, e, of 10 mm and a height, f, of 10 mm and fluid-communicating channels having a length, g, of 40 mm. As a result, it was found that the electrolytic voltage and current efficiency were 3.30 V and 96%, respectively, and in the anode chamber pressure variations of 20 $mmH_2O$ were observed 13 times per minute, but the difference in concentration of the brine in the anode chamber dropped to 10 g/l or less. It was also noted that the concentration of oxygen in chlorine was 0.6%.

COMPARATIVE EXAMPLE 1

Electrolysis of brine was conducted under the conditions of Ex. 1 with the exception that no gas-liquid separation chamber was provided. As a result, it was found that the electrolytic voltage and current efficiency were 3.37 V and 94%, respectively.

It was noted that in the anode chamber a pressure variation of at most 1000 $mmH_2O$ was observed and pressure variations of 500 $mmH_2O$ or more were found 30 times per minute. It was also noted that the concentration of oxygen in chlorine was 1.5%. In addition, a gaseous phase was found on the electrode chambers with blisters on the cation exchange membrane.

What we claim:

1. An electrolyzer, comprising:

a stack composed of a plurality of upright electrolytic cell units, each including an electrolytic cell unit frame bounding a pair of electrode sheets, said pair of electrode sheets being anode- and cathode-side partitions having opposed recesses and projections that are engaged in nesting relationship with each other; and a gas-liquid separation chamber which is integral with an upper edge of said electrolytic cell unit frame.

2. An electrolyzer as claimed in claim 1, wherein an outside of said gas-liquid separation chamber provides a flange surface on which an adjacent electrolytic cell unit can be stacked.

3. An electrolyzer as claimed in claim 1 or 2, further comprising a plurality of passages between said gas-liquid separation chamber and said electrolytic chamber for communicating both said gas-liquid separation chamber and said electrolytic chamber to each other.

4. An electrolyzer as claimed in claim 1, wherein each of said recesses and projections are in a shape of a truncated cone.

5. A method of producing an electrolyzer comprising a stack of electrolytic cell units, each including electrode sheets joined to the projections of a partition sheet obtained by pressing together anode- and cathode-side partitions having recesses and projections that are engaged with each other and further including at least one of a gas-liquid separation chamber built up of a member integral with the upper partition of said electrolytic cell unit and an electrolyte dispensing and feeding chamber built up of a member integral with the lower partition of said electrolytic cell unit, wherein each partition is bent down to form said gas-liquid separation or electrolyte dispensing and feeding chamber with a member integral with said partition sheet.

6. An electrolyzer, comprising:

a stack of upright electrolytic cell units, each including electrode sheets joined to the ribs of a partition sheet obtained by pressing together anode- and cathode-side partitions having recesses and projections that are engaged with each other, wherein:

each electrolytic cell unit includes a partition sheet vertically provided with recesses and projections;

said partition sheet is divided into a plurality of zones in the height direction;

the recesses in one zone are in line with the ribs in the other zone;

one recess in one zone communicates with adjacent recesses in the same zone through a passage; and the recesses in one zone communicate with the recesses in the other zone through fluid-communicating channels.

7. An electrolyzer as claimed in claim 6, wherein said electrolytic cell unit includes at least one of a gas-liquid separation chamber or an electrolyte dispensing and feeding chamber formed of a member integral with said partition sheet.

8. An electrolyzer, comprising:

a stack composed of a plurality of upright electrolytic cell units, each including an electrolytic cell unit frame bounding a pair of electrode sheets, said pair of electrode sheets being anode- and cathode-side partitions having opposed recesses and projections that are engaged in nesting relationship with each other; and an electrolyte dispensing and feeding chamber which is integral with a lower edge of said electrolytic cell unit frame.

9. An electrolyzer as claimed in claim 8, wherein an outside of said electrolyte dispensing and feeding chamber provides a flange surface on which an adjacent electrolytic cell unit can be stacked.

10. An electrolyzer as claimed in claim 8 or 9, further comprising a plurality of passages between said electrolyte dispensing and feed chamber and said electrolytic chamber for communicating both said electrolyte dispensing and feed chamber and said electrolytic chamber to each other.

* * * * *